US005165192A

United States Patent [19]

Markström

[11] Patent Number: 5,165,192

[45] Date of Patent: Nov. 24, 1992

[54] A TRACK-MOUNTED EXCAVATING MACHINE EQUIPPED WITH A WORK TOOL

[76] Inventor: Eskil Markström, PL. 1091, S-940 25 Norrfjärden, Sweden

[21] Appl. No.: 752,601

[22] PCT Filed: Feb. 14, 1990

[86] PCT No.: PCT/SE90/00096

§ 371 Date: Aug. 14, 1991

§ 102(e) Date: Aug. 14, 1991

[87] PCT Pub. No.: WO90/09489

PCT Pub. Date: Aug. 23, 1990

[30] Foreign Application Priority Data

Feb. 14, 1989 [SE] Sweden ..... 8900498

[51] Int. Cl.[5] ..... E02F 3/76; B66C 1/00

[52] U.S. Cl. ..... 37/117.5; 37/DIG. 3; 37/118 R; 414/732

[58] Field of Search ..... 37/117.5, DIG. 3, 118 R, 37/2 R; 414/732, 738, 739

[56] References Cited

U.S. PATENT DOCUMENTS 3,752,237 8/1973 Pinkham et al. .
3,778,111 12/1973 Ciofani ..... 37/117.5 X
3,881,615 5/1975 Albright .
4,222,186 9/1980 Molby ..... 37/117.5 X
4,327,509 5/1982 Bean ..... 37/117.5
4,645,410 2/1987 Royer ..... 37/117.5 X
4,669,947 6/1987 Frost ..... 37/DIG. 3 X
4,825,567 5/1989 Andiano et al. ..... 37/117.5

FOREIGN PATENT DOCUMENTS 0150154 7/1985 European Pat. Off. .
90019 7/1957 Norway .
142455 5/1980 Norway .

*Primary Examiner*—Randolph A. Reese
*Assistant Examiner*—J. Russell McBee
*Attorney, Agent, or Firm*—Burns, Doane, Swecker & Mathis

[57] ABSTRACT

A track-mounted excavating machine comprises a chassis having ground-support tracks, and a cabin mounted on the chassis. A first tool is carried by the cabin, and a second tool is carried by the chassis. The second tool can be (a) extended and retracted toward and away from the chassis, (b) raised and lowered relative to the chassis, and (c) rotated about a vertical axis relative to the chassis. The second tool comprises claws having toothed sides mounted thereon for slidable adjustment toward and away from outer ends of the claws.

11 Claims, 5 Drawing Sheets

A TRACK-MOUNTED EXCAVATING MACHINE EQUIPPED WITH A WORK TOOL

BACKGROUND OF THE INVENTION

The present invention relates to a track-mounted excavating machine equipped with a separate, maneuverable tool, preferably a gripping tool intended for gripping around a post and firmly holding the same.

When erecting telephone cables or power cables, essentially two different systems are employed for the purpose of setting the necessary posts in the ground. One of these systems is known as the giraffe system, in which a gripping tool is mounted on the control cabin of a wheel-driven excavator through the intermediary of a telescopically maneuverable operating arm. The drawbacks with this system are that the gripping tool and the telescopically maneuverable arm are unprotected during transportation and that because of its position on the machine, the arm carrying the gripping tool has difficulty in managing the heaviest posts. Furthermore, a wheeled excavating machine has limited accessibility when the ground is muddy and wet, for instance. Neither is the digging ability of a wheeled excavator as great as that of a tracked excavator or digger, and consequently difficulties can arise when the ground to be dug is frozen.

The other system used to mount the posts required in the erection of overhead telephone and power cables includes a truck-mounted excavating machine equipped with a bucket on which a gripping tool is mounted. The most serious drawback with this system is that the digging and gripping functions of the bucket and tool respectively cannot be carried out simultaneously, and consequently two workmen are needed to carry out the work of mounting the posts in the ground. One workman sits in the machine and with the aid of the gripping tool holds the post in position in a pre-dug hole while the other person fills in the hole around the post manually. An attempt to lessen the effect of this drawback can be made by mounting on the bucket two soil-containers which are filled with soil and operated from the control cabin. When the post is subsequently held in place by the gripping tool, the soil-containers are maneuvered so that the soil will fall into the hole in which the post is placed. The hole is not filled completely, however, and consequently the need for two workmen remains.

SUMMARY OF A PREFERRED EMBODIMENT OF THE INVENTION

These drawbacks are overcome by the tracked excavating machine of the present invention. The tool, preferably a gripping tool, is mounted on a control unit which during transportation is retracted into a protective position in the machine chassis, between the tracks of the machine. This reduces the risk of damage to the tool. The tool can also be maneuvered readily into position with the aid of the control unit, which is operative to adjust the distance between the tool and the excavating machine, and also with the aid of lateral control means and height control means operative to adjust the lateral positions and high positions of the tool respectively. Thus, the tool can be maneuvered independently of the bucket, thereby enabling the individual functions of the tool and the bucket to be performed simultaneously. This will enable the work of mounting posts intended for supporting overhead telephone cables or power cables to be performed by one single workman.

The inventive tracked excavating machine is not restricted by the weight of the posts or prevailing weather conditions or the condition of the ground (can be used on frozen ground, for instance). The ability to use the bucket function and tool function simultaneously and independently of one another renders the excavating machine highly versatile.

BRIEF DESCRIPTION OF THE INVENTION

The invention will now be described in more detail with reference to exemplifying embodiments thereof illustrated in the accompanying drawings, in which FIG. 1 is a side view of truck-mounted excavating machine according to the present invention provided with a control unit, which is shown in a retracted protected position;

DETAILED DESCRIPTION OF A PREFERRED EMBODIMENT OF THE INVENTION

Figure 1:
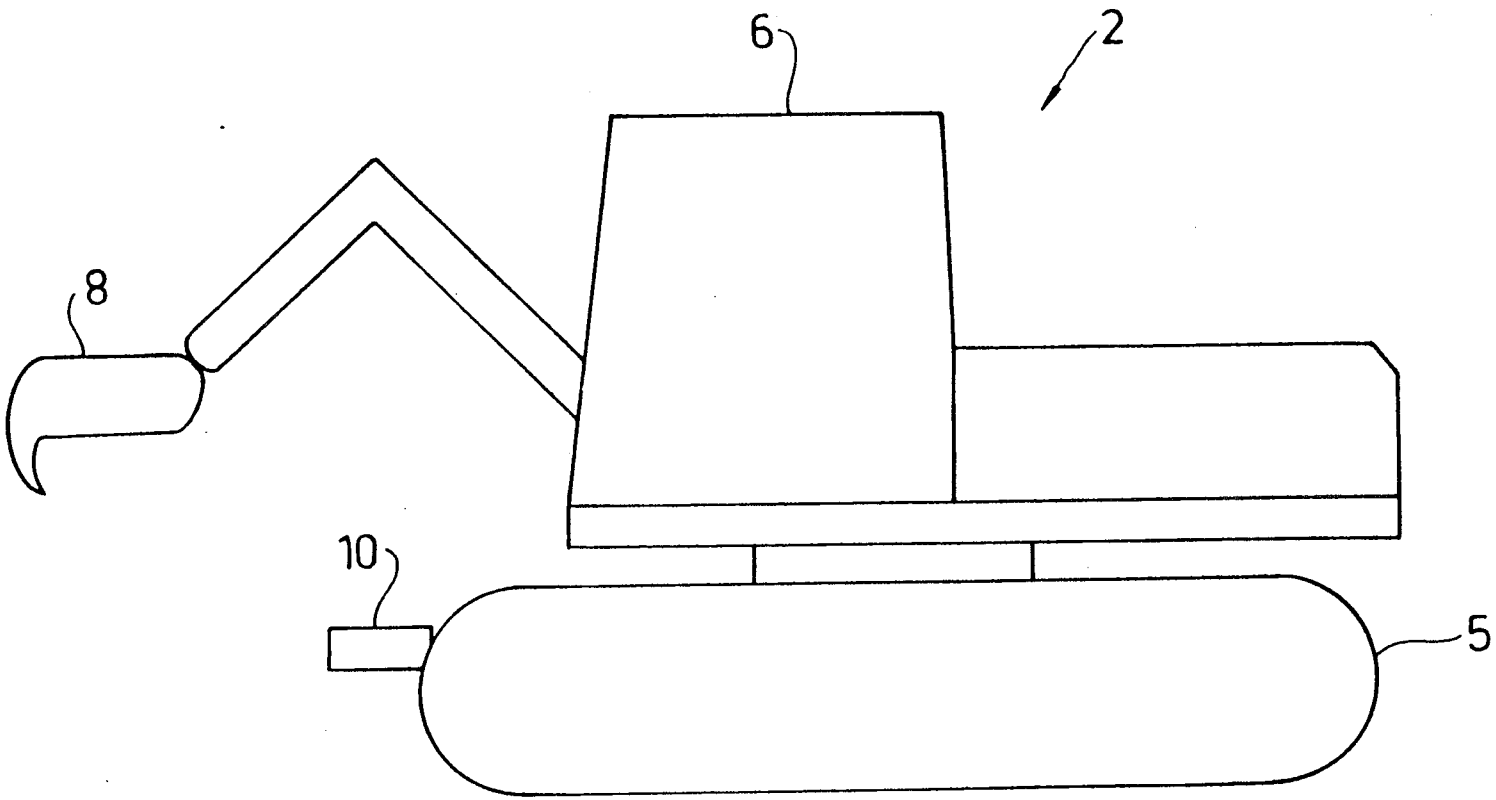

FIG. 1 is a side view of an inventive excavating machine 2. The machine 2 comprises a control cabin 6, two drive tracks 5, a bucket 8, and a working tool 10, preferably a gripping tool 10. FIG. 1 shows the machine 2 in its transport position, in which the tool 10 mounted on a control unit (not shown) is retracted into a protected inner position in the carriage 4 of the excavating machine 2, between the tracks 5.

Figure 2:
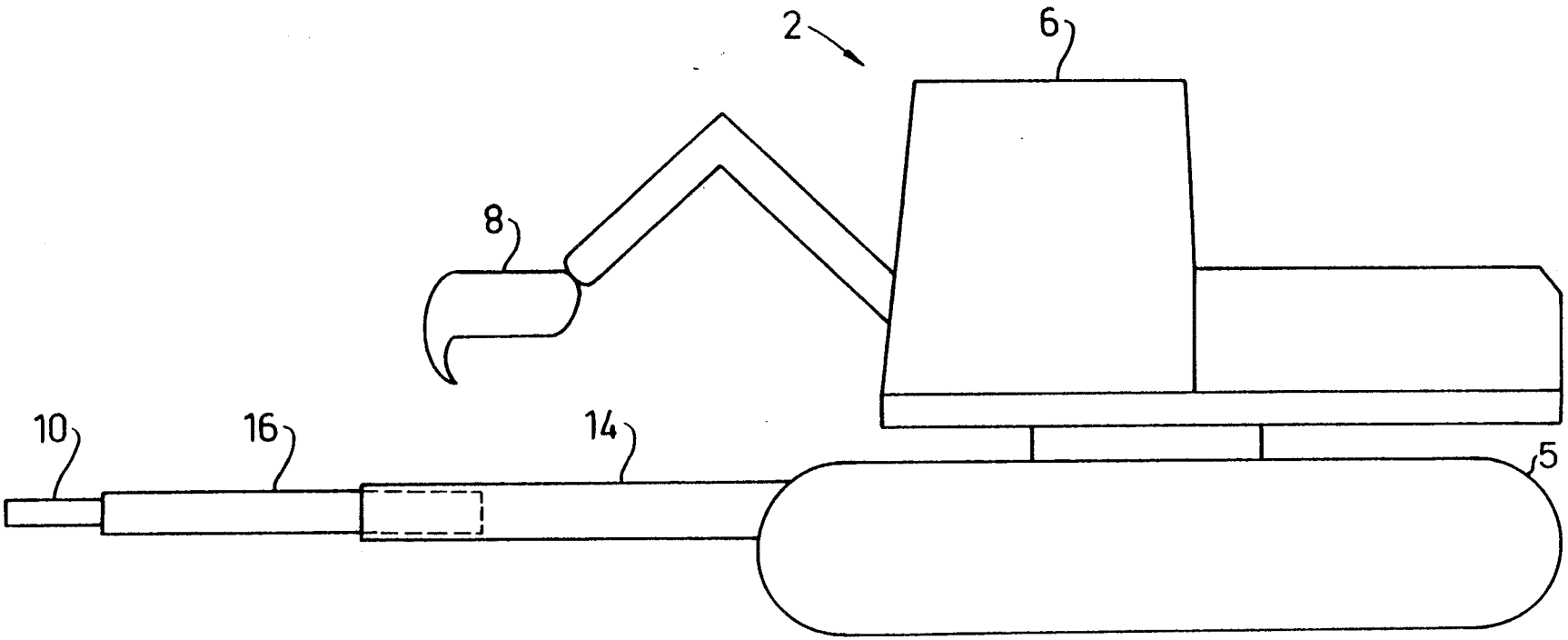
FIG. 2 is a side view similar to the side view of FIG. 1, but with the control unit in an extended working position.

FIG. 2 is a side view of the inventive machine shown in FIG. 1 and shows the tool 10 extended outwardly to a working position. A control unit 14, 16 carrying the tool 10 is also extended in this position of the tool. The control unit in the form of a boom structure comprises a first part 14 and a second part 16. The first part 14 is maneuvered with the aid of a motor unit not shown. The second part 16 can only be maneuvered when the first part 14 is fully extended. A hydraulic piston-cylinder device (not shown) is used to extend the second part 16 from its retracted position in the first part 14. The distance of the tool 10 from the machine 2 can be adjusted through the intermediary of the control unit 14, 16 in the state illustrated in FIG. 2. The tool can also be adjusted laterally and vertically with the aid of lateral control means and height control means respectively, so as to enable the tool 10 to be adjusted to suitable working positions, as will be explained.

Figure 3:
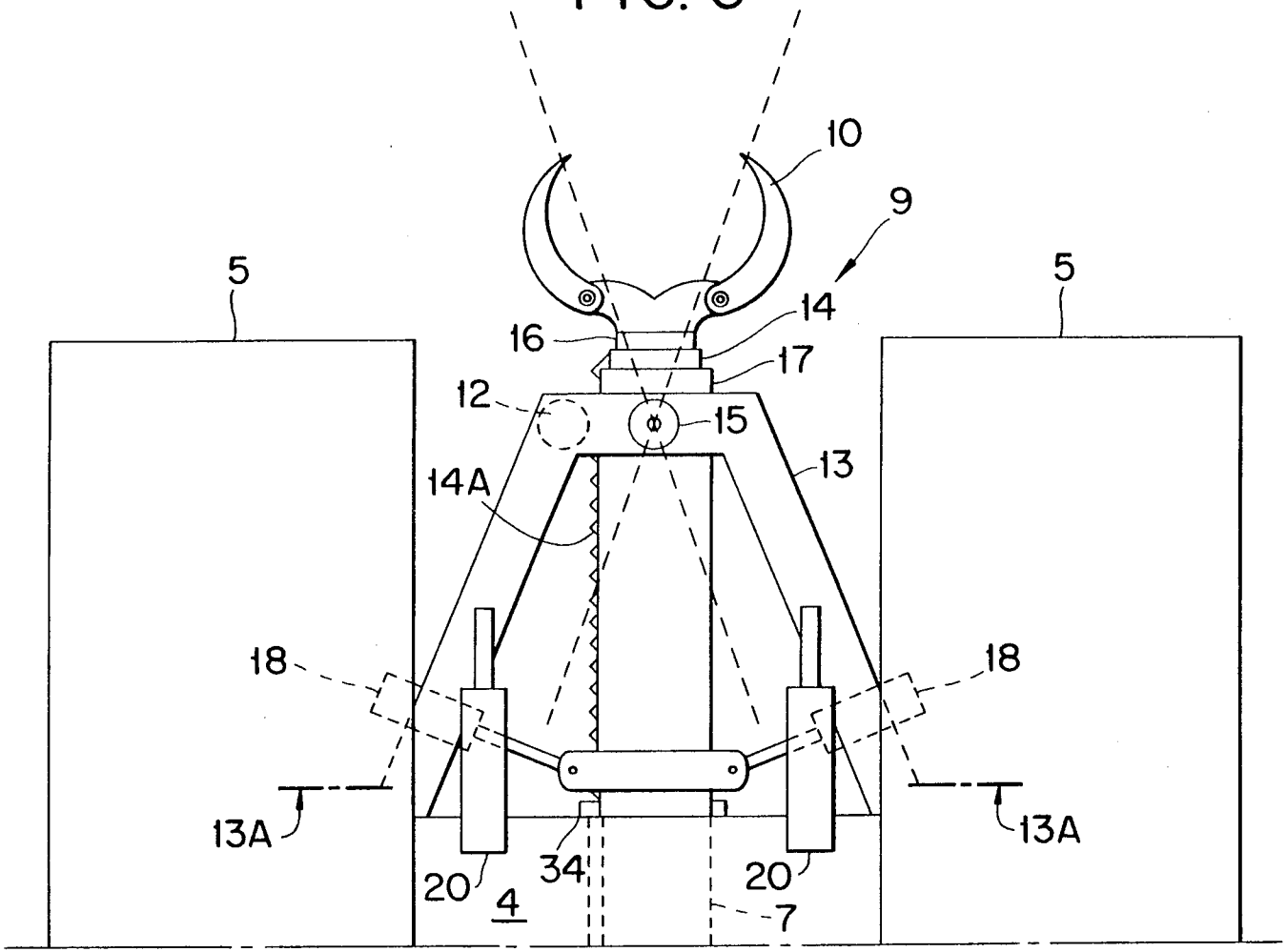
FIG. 3 is a plan view from above of the machine of FIG. 1 depicting an arrangement comprising a tool (in this instance a gripping tool) and a control unit, and shows the positioning of the unit in the machine.

FIG. 3 illustrates from above an arrangement 9 which includes a tool 10 and a control unit 14, 16, said Figure showing the position of the arrangement 9 on the machine 2. FIG. 3 also illustrates the position of the arrangement 9 in a transport position, i.e. the retracted, protected position shown in FIG. 1. In this protected position, the first part 14 and the second part 16 of the control unit are completely retracted one within the other, i.e. the second part 16 is retracted in the first part 14. When occupying said transport position, the major portion of said unit-parts are accommodated in a passageway 7 in the under-chassis of the machine 2. Only the tool 10 will project beyond the tracks 5 of the machine 2 in this protected position of the arrangement. When the machine operator wishes to use the tool 10, he/she activates a hydraulic motor 12, such as to advance the first part 14, through the intermediary of a toothed drive for instance, to a fully extended position, in which it is locked by a shoulder 34 carried by the first part 14. The toothed drive includes teeth 14A of the first part which extend through a slot formed in a guide tube 17 within which the parts 14, 16 are slidable. The other part 16 of the control unit is located substantially in the passageway 7 of the chassis 4 and cannot be extended to a desired position until the first part of said unit is locked in position. This will enable the adjustments to be made to the distance at which the tool is located from a post on which cables are to be mounted. The tool 10 can be adjusted laterally with the aid of two hydraulic piston-cylinder devices 18 movably mounted on the chassis 4. Lateral movement of the tool 10 is determined, inter alia, by a vertical pivot 15 which connects a frame 13 and the guide tube 17, the arrangement 9 being rotatable about said pivot axis 15. The frame 13, the guide tube 17, and the parts 14, 16 constituted a supporting mechanism for the working tool 10. The broken lines indicate the lateral outer positions of the tool 10 when the tool has been turned about the pivot 15. The vertical or height position of the gripping tool 10 can be adjusted with the aid of two hydraulic piston-cylinder devices 20 movably mounted on the chassis 4 and the frame 13 to raise the outer end of the frame relative to the chassis 4 about a horizontal pivot axis 13A. Thus, as a result of this three-dimensional setting of the tool 10, the machine operator is able to grip the post and hold the post firmly in a hole intended therefor, with the aid of two hydraulic piston-cylinder devices (not shown), one for each gripping claw. The machine operator is then able to fill-in the hole around the post with the aid of the bucket 8, so that the post will stand firm. These two functions, the gripping function and the digging function, can be performed simultaneously and independently of one another, since the control cabin (6, see FIGS. 1, 2) and therewith the bucket 8 can be rotated relative to the chassis 4 in a known manner.

Normally, only one hydraulic outlet for serving five mutually hydraulic functions at the same time is found on a conventional excavating machine. Consequently, the inventive excavating machine is provided with three additional activating devices, for instance hydraulic and magnetic valves, which are operative to control the supply of oil to the hydraulic piston-cylinder devices for carrying out a maximum of eight functions simultaneously.

Figure 4:
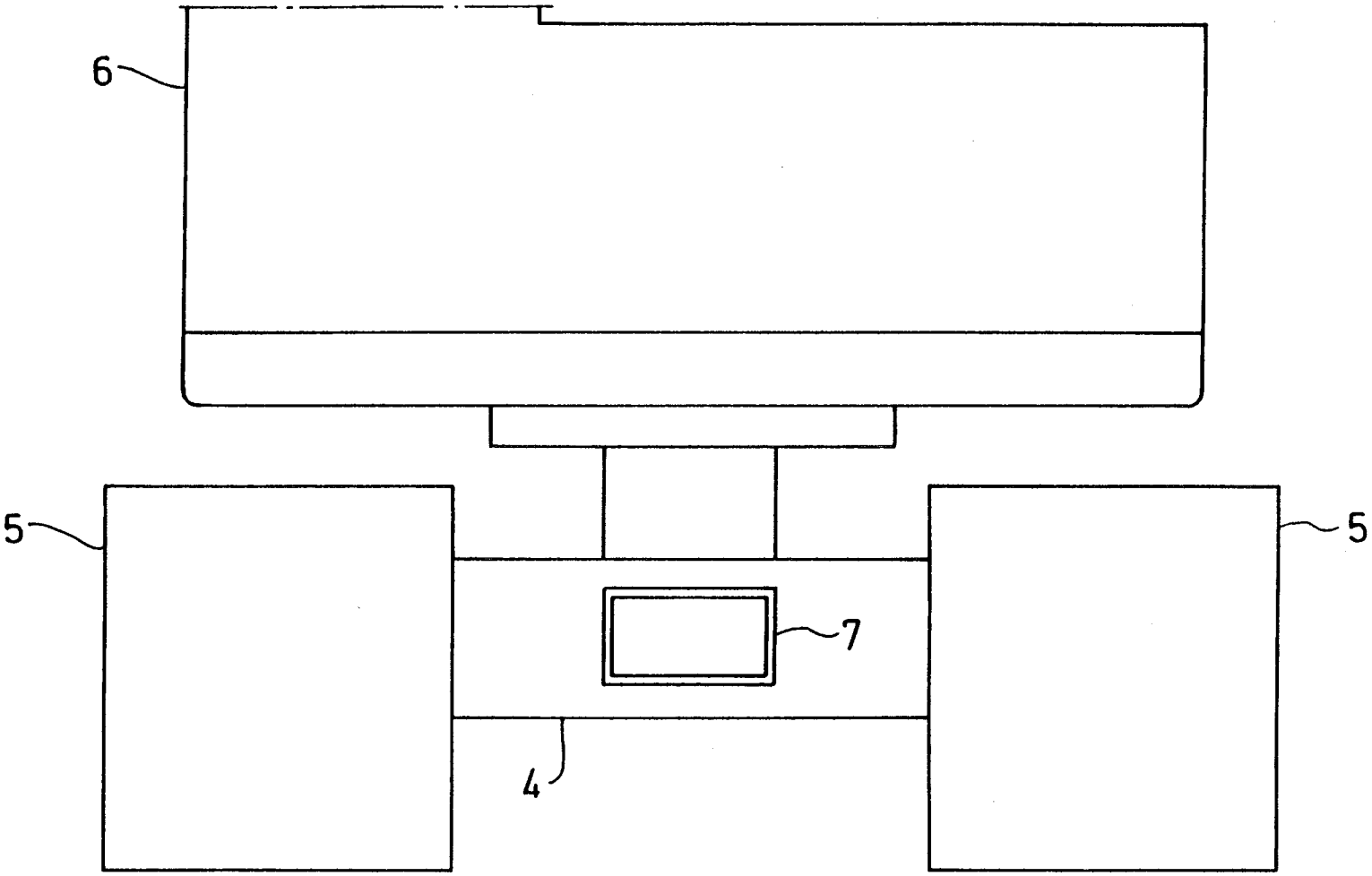
FIG. 4 is a front view of the machine of FIG. 1 illustrating the positioning of said arrangement (not shown in detail) in the underchassis of the machine.

FIG. 4 is a front view of an inventive excavating machine, although the arrangement 9 shown in FIG. 3 has not been included. Provided in the chassis 4, between the tracks 5, is a passageway 7 which in the transport position of the arrangement (see FIG. 3) accommodates a major portion of the aforesaid first part 14, the second part 16 and the hydraulic piston-cylinder device by means of which said second part is operated, so that the arrangement is located in a retracted, protective position. This positioning of the arrangement and associated tool 10 also enables the bucket 8 to be maneuvered in three dimensions, irrespective of maneuvering of the tool 10, since the control cabin 6 and the bucket can be rotated without needing to move the chassis 4 and thus the tool 10.

Figure 5:
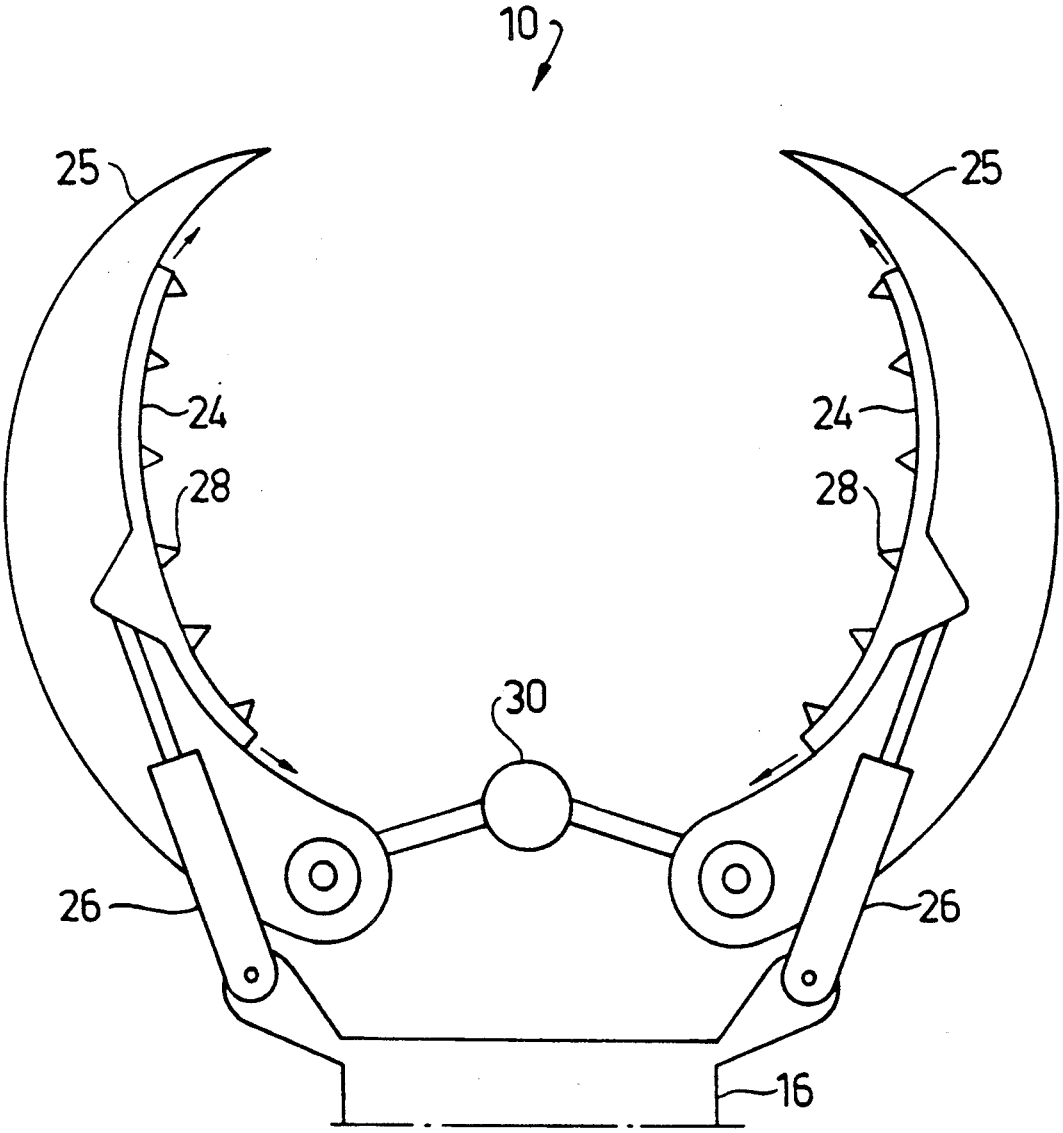
FIG. 5 is plan view of a gripping tool for use in conjunction with the inventive excavating machine.

FIG. 5 illustrates a gripping tool 10 intended for use with the inventive excavating machine. The gripping tool 10 comprises two gripping claws 25 which are connected to said second part 16 and which can be maneuvered between gripping and open positions with the aid of two hydraulic piston-cylinder devices not shown.

The gripping tool 10 also includes two slides 24 which are mounted on the claws 25 and which are slideable on roller bearings, for example. Each of the slides 24 is maneuvered with the aid of a respective hydraulic piston-cylinder 26 in the directions of the arrows shown in the Figure. The slides are also provided with teeth 28 which ensure that a good gripping action is obtained around, for instance, a post. A post gripped by the tool 10 can be rotated by maneuvering the slides 24 with the aid of the piston-cylinder devices 26. The tool 10 also includes a slide roller 30 located between the gripping claws 25 and having a convexly curved surface against which the post can abut so as to facilitate rotation of the post.

I claim:

1. A track-mounted excavating machine comprising:
a chassis having tracks on opposite sides thereof;
a control cabin mounted on said chassis;
first tooling means including an excavating bucket mounted on said cabin; and
second tooling means mounted on said chassis and being actuable independently of said first tooling means, said second tooling means comprising:
a boom structure arranged for reciprocation between a retracted inner position located between said tracks and an extended outer position,
a working tool mounted at an outer end of said boom structure so as to be movable toward and away from said chassis when said boom structure is retracted and extended, respectively,
tool raising means for raising said outer ed of said boom structure for raising said working tool relative to said chassis, and
tool turning means for producing rotation of said tool relative to said chassis about an axis, said axis being arranged such that it extends vertically when said boom structure is horizontal.

2. A machine according to claim 1, wherein said tool turning means includes means for displacing said boom structure about said axis.

3. A machine according to claim 1, wherein said boom structure comprises first and second telescoping parts, said second part being disposed within said first part, said working tool being carried at an outer end of said second part.

4. A machine according to claim 3, wherein said boom structure further comprises a guide tube mounted on said chassis for rotation about said generally vertical axis, said telescoping parts being mounted in said guide tube.

5. A machine according to claim 4, wherein said second tooling means further comprises a frame mounted on said chassis, said guide tube being mounted by means of a pivot on a portion of said frame which is raisable relative to said chassis, said pivot defining said axis.

6. A machine according to claim 1, wherein said working tool comprises a gripping tool for gripping a periphery of an upstanding post.

7. A machine according to claim 6, wherein said first and second tooling means are disposed at the same end of said vehicle so that said bucket fills-in a hole while said gripping tool holds a post seated in the hole.

8. A machine according to claim 6, wherein said gripping tool includes two claws having surfaces facing one another, two toothed slides being mounted on respective ones of said surfaces for sliding movement therealong toward and away from outer ends of said claws, and means for sliding said slides along said surfaces.

9. A machine according to claim 8 including an element having a convexly curved surface disposed between inner ends of said claws and positioned to be contacted by an upstanding post gripped by said claws.

10. A track-mounted excavating machine for anchoring a post in a hole, comprising:

a chassis having tracks on opposite sides thereof;

a control cabin mounted on said chassis;

first tooling means mounted on said chassis and including an excavating bucket;

second tooling means mounted on said chassis and being actuable independently of said first tooling means, said second tooling means including a post-gripping tool which can be extended toward and away from said chassis, said first and second tooling means being situated at the same end of said vehicle such that said bucket can be manipulated to fill-in a hole while said post-gripping tool holds a post seated in the hole.

11. A track-mounted excavating machine according to claim 10, wherein said post-gripping tool includes a pair of claws.

* * * * *